US007922435B2

(12) United States Patent
Sanmiya

(10) Patent No.: US 7,922,435 B2
(45) Date of Patent: Apr. 12, 2011

(54) SHEET COLLECTING DEVICE AND BOOKBINDING APPARATUS COMPRISING THE SAME

(75) Inventor: Shigeyuki Sanmiya, Yamanashi-ken (JP)

(73) Assignee: Nisca Corporation, Yamanashi (JP)

( * ) Notice: Subject to any disclaimer, the term of this patent is extended or adjusted under 35 U.S.C. 154(b) by 978 days.

(21) Appl. No.: 11/797,688

(22) Filed: May 7, 2007

(65) Prior Publication Data

US 2007/0257421 A1 Nov. 8, 2007

(30) Foreign Application Priority Data

May 8, 2006 (JP) ..... 2006-129669

(51) Int. Cl.

| | |
|---|---|
| ***B42C 9/00*** | (2006.01) |
| ***B42C 11/00*** | (2006.01) |
| ***B42C 11/02*** | (2006.01) |
| ***B42B 5/00*** | (2006.01) |
| ***B42B 5/04*** | (2006.01) |

(52) U.S. Cl. ..... 412/9; 412/18; 412/33; 412/36; 412/37; 412/901; 412/19

(58) Field of Classification Search ..... 412/4, 8, 412/9, 12, 18, 19, 24, 33, 34, 36, 37, 901, 412/3

See application file for complete search history.

(56) References Cited

U.S. PATENT DOCUMENTS 5,899,649 A * 5/1999 Kohtani et al. ..... 412/33
2006/0210378 A1 * 9/2006 Geldmeier et al. ..... 412/3

* cited by examiner

*Primary Examiner* — Dana Ross
*Assistant Examiner* — Justin V Lewis
(74) *Attorney, Agent, or Firm* — Manabu Kanesaka

(57) ABSTRACT

A sheet collecting device includes a tray on which sheets are placed, a sheet discharging roller for transferring sheets to the tray, an abutment regulating device for regulating a leading end and a trailing end of the sheets on the stacking tray in a conveying direction, and an aligning device for aligning the sheets relative to the abutment regulating device. The stacking tray includes a tray base supported by an apparatus frame and a plate member disposed on the tray base for placing and supporting at least some of the sheets. The plate member is supported on a top surface of the tray base so as to be movable toward an abutment regulating member. A biasing device is provided between the plate member and the tray base to bias the plate member toward the abutment regulating member.

11 Claims, 7 Drawing Sheets

SHEET COLLECTING DEVICE AND BOOKBINDING APPARATUS COMPRISING THE SAME

BACKGROUND OF THE INVENTION AND RELATED ART STATEMENT

The present invention relates to a sheet collecting device that collects and sets sheets carried out from an image forming apparatus or the like, into a bundle. In particular, the present invention relates to improvements in a collecting tray structure on which sheets are orderly aligned with one another before being transferred from a tray position, at which the sheets are set, to a processing position located away from the tray position.

Collecting devices of various structures have been commonly used to stack sheets sequentially carried out from an image forming apparatus, on a tray. A typical known collecting structure is a device comprising a tray inclined at a predetermined angle and on which sheets conveyed from above are stacked, the tray having a regulating wall at its end (leading end or trailing end) so that sheets fall down on the tray under their own weights and abut against the regulating wall for alignment.

Bookbinding devices and the like stack and set sheets into a bundle, align the sheets on the tray with one another at one end in their width direction and at another end (leading end or trailing end) in their longitudinal direction, and transfer the sheet bundle to a processing position different from the collecting position for pasting or stapling. These devices need to accurately align the sheets on the tray with one another. If the sheets edges are misaligned when the sheets are set on the tray, the bookbound sheets may have missing pages or not be aesthetically pleasing. Thus, bookbinding devices set the collecting tray in a substantially horizontal direction or at an inclination small enough to prevent the sheets from moving under their own weight. A preferred collecting tray structure includes one in which the sheets are reliably abutted against a regulating member for alignment using an aligning roller or another aligning means provided on the tray.

For example, Japanese Patent Laid-Open Publication No. 2003-103959 has roller means disposed above a horizontally located tray and abuts the uppermost one of sheets collected on the tray against a regulating member disposed at the trailing end of the sheets, with the side edge of the sheet moving along a guide plate. Thus, compared to the conventional technique for abutting sheets against the predetermined regulating member for alignment under their own weight, the technique in this document can forcibly move the sheet via conveying means such as a roller to abut it against the regulating member located at the leading end of the sheet, allowing the sheet edge to reliably abut against the regulating member for alignment regardless of the condition of the sheet.

When sheets are stacked and housed on the tray having the aligning means thereon for aligning the bundled sheets with one another at their edge, wherein the leading or trailing end of each sheet is abutted against the regulating means for alignment, as described above, the tray may disadvantageously be swung by vibration of the device, loosening the sheet bundle. For example, when the regulating means located at the leading or trailing end of the tray has a top surface regulating surface and is swung up and down every time sheets enter the tray, motion of the regulating means may vibrate the tray, loosening the sheet bundle on the tray.

This phenomenon will be described with reference to FIG. 8. A tray 100 has a regulating member 101 having an edge engaging surface 101*a* against which the edge, i.e., the trailing edge, of sheets is abutted for regulation and a pressure regulating surface 101*b* that corrects the upward warpage of the sheets. Then, vertical swing of the pressure regulating surface 101*b* may swing the tray 100 in the direction of an arrow in the figure owing to a structure for mounting the tray on an apparatus frame. Thus, when the tray is swung by vibration of the device, the sheets on the tray may be loosened as shown in FIG. 8(*b*).

The present invention is based upon knowledge that when a plate member with a small mass is disposed on a tray (main body) on which sheets are placed, so as to be movable in a regulating direction, it prevents possible swing of the tray main body in the regulating direction, caused by vibration of the device, from propagating to the sheets.

One object of the present invention is to provide a sheet feeding device that keeps sheets on a tray aligned with one another even when the tray undergoes device vibration or any other external impact when the edge of sheets is abutted against a regulating member for alignment.

Another object of the present invention is to provide a bookbinding device which sets sheets with images formed thereon on a collecting tray for alignment and then subjects the sheet bundle to bookbinding, the bookbinding device being capable of orderly aligning the sheets with one another at their edge.

The other objects and features of the present invention will be apparent from description of embodiments based on accompanying drawings.

SUMMARY OF THE INVENTION

Accordingly to the invention, a device comprises a substantially horizontal stacking tray on which sheets are placed, sheet discharging roller means for transferring the sheets to the stacking tray, abutment regulating means for regulating a leading end and a trailing end of the sheets on the stacking tray in a conveying direction, and aligning means for aligning the sheets with one another relative to the abutment regulating means.

The stacking tray comprises a tray base supported by an apparatus frame and a plate member disposed on the tray base and on which at least some of the sheets are placed and supported. The plate member is supported on a top surface of the tray base so as to be movable toward an abutment regulating member. Biasing means is provided between the plate member and the tray base to bias the plate member toward the abutment regulating member. Therefore, even when vibration, or the like, causes a force acting in a direction in which the sheets are loosened at their end surface to be exerted on the tray base, the sheets are orderly aligned with one another because the plate member uses the urging means to press the sheet end surface against the regulating member.

The aligning member comprises roller means transferring an uppermost one of the sheets placed and housed on the stacking tray to the abutment regulating means to align the sheets with one another relative to the abutment regulating means. The roller means is coupled to driving means so as to be rotatable forward and backward. Thus, sheets from a sheet discharging port have their end surface reliably aligned with the regulating member and have their posture maintained by the plate member.

The abutment regulating member comprises an edge engaging surface that abuts against the edge of the sheets on the stacking tray for alignment and a pressure engaging surface that engages with and depresses a top surface of the uppermost surface. The abutment regulating member is movable between a retracting position where the abutment regulating member is away from the sheet top surface and a regulating portion where the abutment regulating member engages with the sheet top surface, every time sheets enter the tray. This allows even sheets with a curled edge to be orderly aligned with the regulating member.

A bookbinding apparatus in accordance with the present invention comprises a stacking tray on which sequentially fed sheets are stacked and housed, sheet bundle conveying means for transferring a sheet bundle from the stacking tray to a predetermined processing position, adhesive applying means for applying an adhesive to the sheet bundle from the stacking tray, and cover binding means for binding a cover sheet to a back of the sheet bundle with the adhesive applied thereto by the adhesive applying means.

The stacking tray comprises abutment regulating means for regulating one of a leading edge and a trailing edge of sheets on the stacking tray in a conveying direction and aligning means for transferring the sheets toward the abutment regulating member. The stacking tray is supported by an apparatus frame so as to be able to elevate and lower in a vertical direction between a sheet housing position and a sheet carry-out position. The stacking tray comprises a tray base supported by the apparatus frame so as to be able to elevate and lower in the vertical direction, and a plate member disposed on the tray base and on which at least some of the sheets are placed and supported. The plate member is supported on a top surface of the tray base so as to be movable toward the abutment regulating member. Biasing means is provided between the plate member and the tray base to bias the plate member toward the abutment regulating member.

According to the present invention, the plate member on which sheets are placed is disposed on the tray base supported by the apparatus frame is disposed so as to be movable in the sheet regulating direction. The plate member is biased toward the abutment regulating member by the biasing member. Consequently, even when the device vibrates to exert a force on the tray base such that the tray base leaves the abutment regulating member, the sheets are prevented from being loosened because the plate member, which supports the sheets, is biased toward the abutment regulating member. The sheet edge is thus held against a regulating edge surface of the regulating member, allowing a predetermined bookbinding process to be executed on the sheets during a subsequent sheet binding step.

In particular, when the regulating member, against which the sheets are abutted for regulation, has a top surface regulating surface that presses a top surface of the sheet edge for regulation and the regulating member is swung up and down every time sheets enter the tray, even if the vertical swing of the regulating member causes vertical vibration to propagate to the tray base, the sheets are prevented from being loosened and can be orderly collected.

DETAILED DESCRIPTION OF THE EMBODIMENTS

Figure 1:
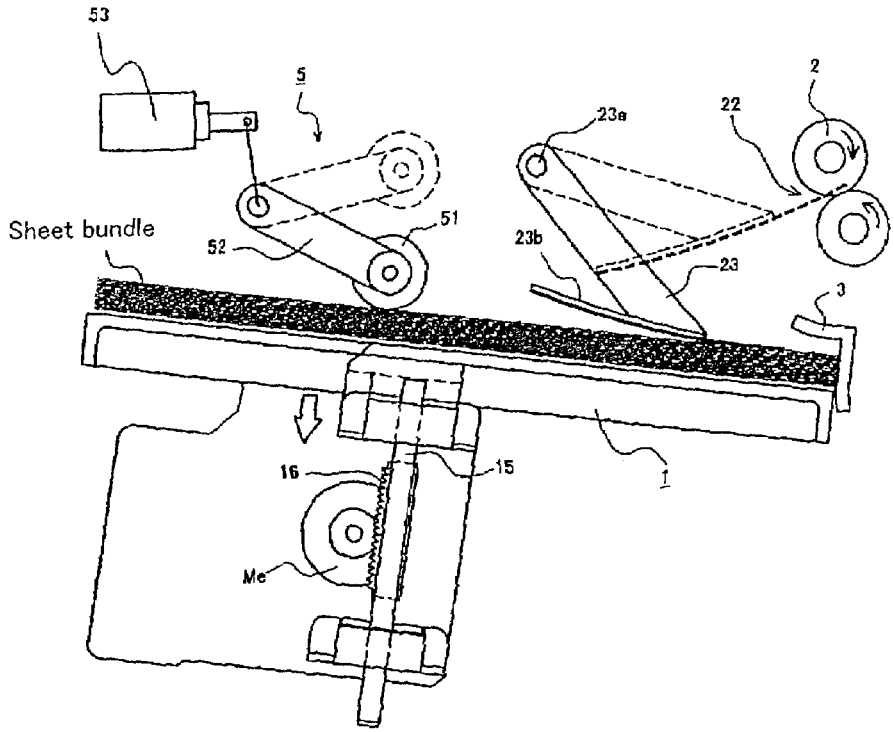
FIG. 1 is a diagram showing the entire configuration of a sheet collecting device in accordance with the present invention.
Figure 2:
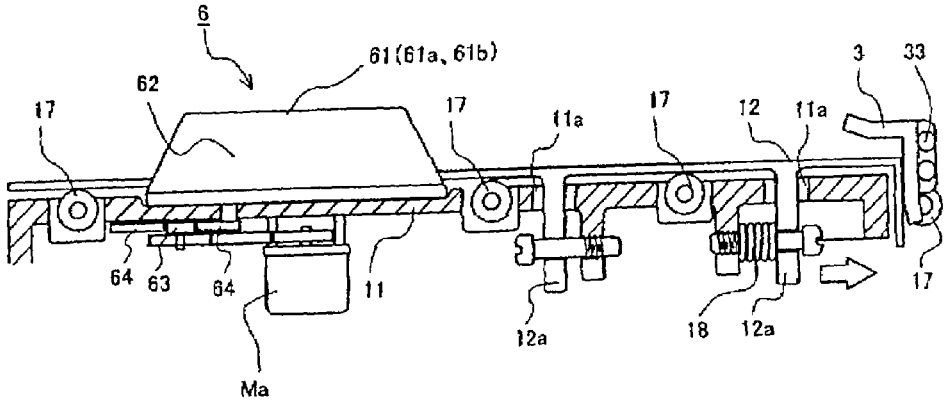
FIG. 2 is a diagram illustrating a tray structure on which sheets are stacked.
Figure 3:
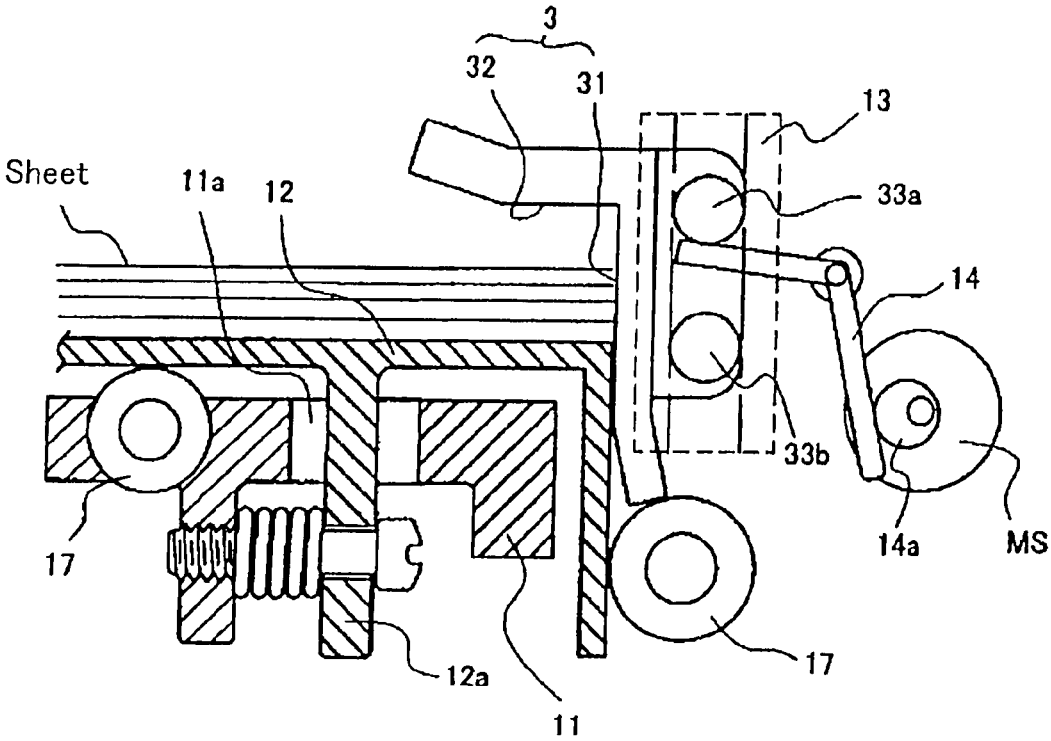
FIG. 3 is a diagram illustrating the configuration of regulating means in the device in FIG. 1.
Figure 4A:
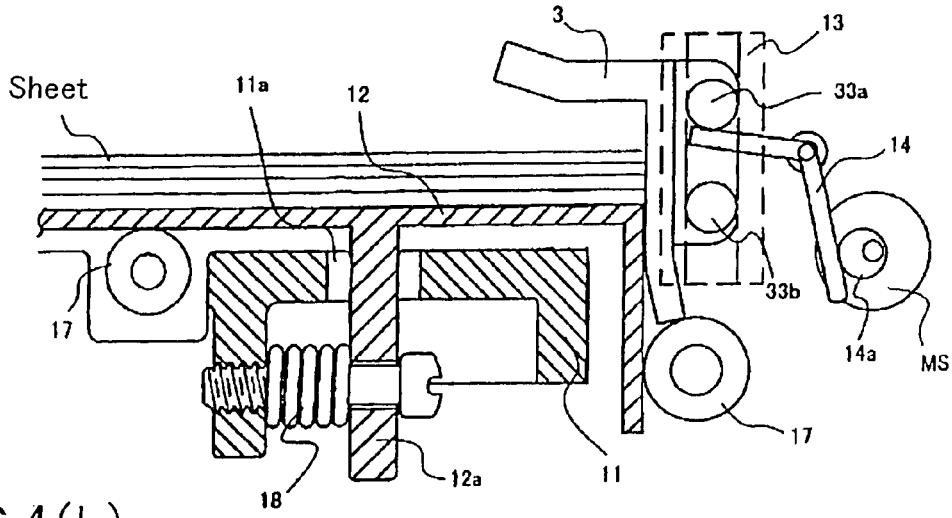
FIGS. 4(*a*)-4(*c*) are diagrams illustrating the condition of sheets when the device in FIG. 1 is vibrated.
Figure 4B:
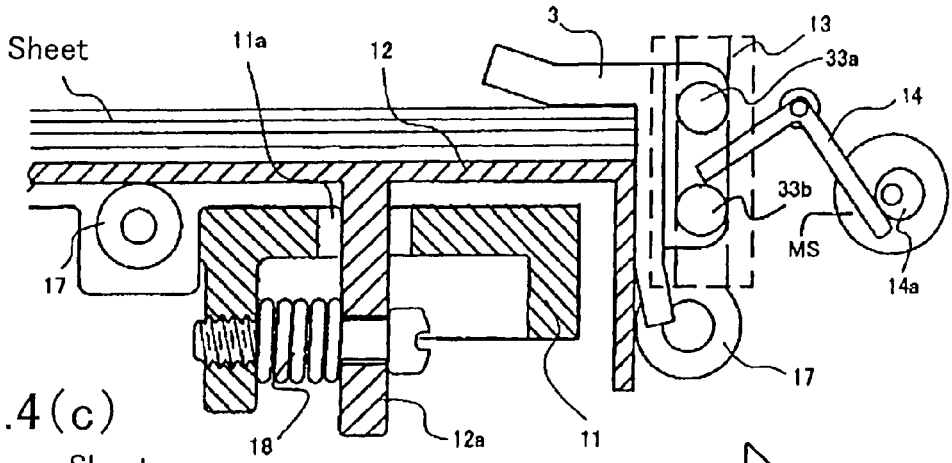
Figure 4C:
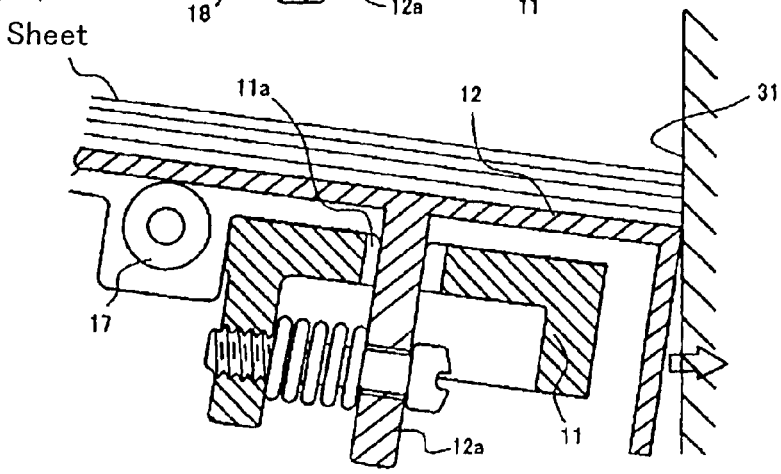

With reference to the drawings, a detailed description will be given below of a sheet feeding device and an image reading device in accordance with the present invention. FIG. 1 is a diagram showing the entire configuration of a sheet collecting device in accordance with the present invention. FIG. 2 is a diagram illustrating a tray structure on which sheets are stacked. FIG. 3 is a diagram illustrating the configuration of regulating means of the device in FIG. 1. FIGS. 4(*a*) to 4(*c*) are diagrams illustrating the condition of the device in FIG. 1 observed when vibration occurs in the device in FIG. 1.

A sheet collecting device C in accordance with the present invention comprises a stacking tray 1, sheet discharging roller means 2 for carrying sheets onto the tray, abutment regulating member 3 for regulating the leading or trailing end of the sheets on the staking tray in a conveying direction, as shown in FIG. 1. The stacking tray 1 is composed of a tray member such as a synthetic resin and located on an apparatus frame 10 in a substantially horizontal direction so that sheets can be stacked and housed on the stacking tray 1. The illustrated stacking tray 1 comprises a tray base 11 and a placement plate 12 both described below and is mounted on the apparatus frame 10 so as to be able to elevate and lower. Sheet discharging roller means 2 is disposed above the stacking tray 1 on a sheet discharging path P3 to carry out sheets from a sheet discharging port 22 onto the stacking tray 1. The sheet discharging roller means 22 is rotated in the direction of an arrow in the figure by a driving motor (not shown). A sheet sensor Se is also disposed at the sheet discharging port 22 to detect a trailing edge of a sheet. A sheet guide 23 is located downstream of the sheet discharging port 22 so as to be swingable around a support shaft 23*a*.

The sheet guide 23 guides sheets from the sheet discharging port 22 onto the stacking tray 1 and then guides the sheets with their top surface pressed to the abutment regulating member 3. Thus, the sheet guide 23 is coupled to driving means such as an electromagnetic solenoid so as to swing around the support shaft 23*a* and has a flexible pressing piece (Mylar or the like) 23*b*. The abutment regulating member ("regulating member"), against which the leading or trailing end of the sheets in a sheet discharging direction (leftward in FIG. 2) is abutted, is also provided for regulation. Regulating member 3 is located to regulate the trailing end of the sheets in the sheet discharging direction and is supported by the apparatus frame 10.

As shown in FIG. 3, the regulating member 3 comprises an edge engaging surface 31 that regulates the trailing edge of sheets and a pressure engaging surface 32 that engages with the top surface of the sheets. The regulating member 3 is supported so as to be movable in the vertical direction of FIG. 3 with guide rollers 33 (33*a* and 33*b*) fixed in a guide rail 13 disposed on the apparatus frame 10. The regulating member 3 engages with a shift lever 14 that is reciprocated in the vertical direction of FIG. 3 by a cam 14*a* coupled to a shift motor MS. The shift motor MS is controlled to start to move the regulating member 3 to a retracting position where it is retracted upward from the sheet top surface when timer means indicates, on the basis of a signal from the sheet sensor Se at the sheet discharging port, that the sheet trailing end has reached the pressure engaging surface 32.

Aligning means 5 (hereinafter referred to as first aligning means) is located above the stacking tray 1 to transfer sheets carried onto the tray to the regulating member 3 for abutment. The first aligning means 5 is retracted upward when the leading end of sheets enters the stacking tray 1 and engages with and transfers the sheets in the sheet discharging direction. After the trailing end of the sheets is carried onto the stacking tray, the sheets are reversed and then transferred toward the regulating member. The first aligning means comprises a roller 51 and a swinging arm 52 that moves the roller 51 up and down and is coupled to a forward and backward motor M1. Reference numeral 53 in the figure denotes an electromagnetic solenoid that moves the swinging arm 52 up and down. The forward and backward motor M1 starts to rotate in the sheet discharging direction when, on the basis of a signal indicating that sheet sensor Se has detected the leading end of the sheets, the timer means indicates that the swinging arm 52 has moved from the retracting position to an operative position where the arm 52 comes into contact with the sheets. The forward and backward motor M1 starts to rotate in an opposite sheet-discharging direction when, on the basis of the above signal, the timer means indicates that a predetermined time has passed from a signal indicating that the sheet sensor Se has detected the trailing end of the sheets.

The stacking tray 1 also has second aligning means 6 that aligns the carried-in sheets with one another in the width direction (which is orthogonal to a sheet discharging direction) Second aligning means 6 comprises a lateral pair of side edge aligning plates 61 (61*a* and 61*b*) against which a side edge of sheets is abutted for alignment and an aligning motor Ma that allows the right and left side edge aligning plates 61 to approach and leave each other relative to the center of the sheets. The lateral pair of side edge aligning plates 61 comprises a guide surface 62 movably supported in a slit groove formed in the stacking tray 1 in the width direction. The side edge aligning plates 61 engage with each other on a rear surface (the bottom surface in FIG. 2) of the staking tray so as to move by the same amount. The side edge aligning plates 61 are coupled to an aligning motor Ma. Various known methods are used for this driving mechanism. The illustrated driving mechanism, rack gears 64 disposed on the right and left side edge aligning plates 61 are meshed with a pinion 63 coupled to the driving motor Ma. The pinion 63 rotates to move the side edge aligning plates 61 in the laterally opposite directions.

The stacking tray formed as described above is supported by the apparatus frame 10 so as to be movable between a stacking position where sheets are accommodated in the apparatus frame 10 and a carry-out position different from the stacking position. Stacking tray 1 is mounted so as to be able to elevate and lower between the stacking position, shown by a solid line in FIG. 5, and the carry-out position, shown by a dashed line in FIG. 5. A sheet bundle accommodated at the stacking position is delivered, for example, to the grip conveying means at the carry-out position. Thus, the stacking tray 1 has a lateral pair of elevating and lower stems 15 borne by the apparatus frame and a rack gear 16 coupled to an elevating and lowering motor Ma disposed on the apparatus frame 10.

The present invention is thus characterized by the stacking tray 1 configured as follows. First, the stacking tray 1 comprises a tray base 11 fixed to the apparatus frame or supported by the apparatus frame so as to be able to elevate and lower and a placement plate 12 provided on the tray base 11 and on which at least some of the sheets are placed and supported. The placement plate 12 is placed on a top surface of the tray base 11 so as to support at least some of the sheets and has a hanging piece 12*a* fittingly supported in a slit groove 11*a* in the tray base 11 so as to be movable toward the regulating member 3.

Reference numeral 17 in the figure denotes a guide roller disposed on the tray base to allow the placement plate 12 to move smoothly on the tray base 11. The hanging piece 12*a* of the placement plate 12 has biasing means, e.g., a spring 18, for always biasing the placement plate 12 toward the regulating member 3. The tray base is composed of a material with a mechanical strength appropriate to stack and support sheets on itself and is correspondingly shaped. The placement plate 12, backed up by the tray base 11, is composed of a relatively light material, for example, a thin metal plate. The placement plate 12 is always biased toward the regulating member 3 by the biasing means (spring 18) as described above.

Figure 8A:
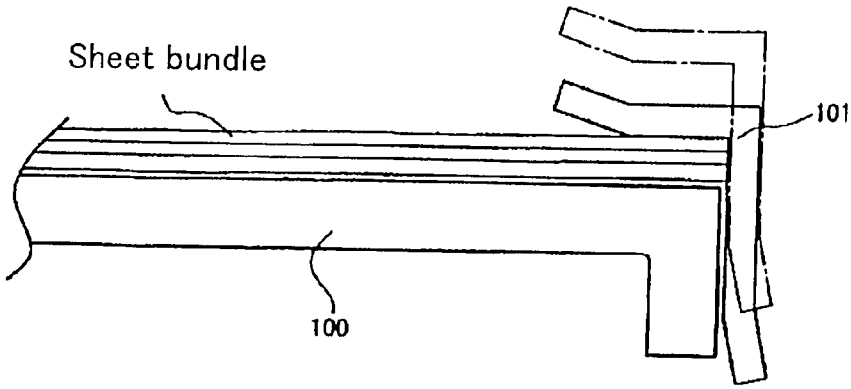
FIGS. 8(*a*)-8(*c*) are diagrams illustrating the behavior of sheets observed when vibration or the like occurs in a conventional device.
Figure 8B:
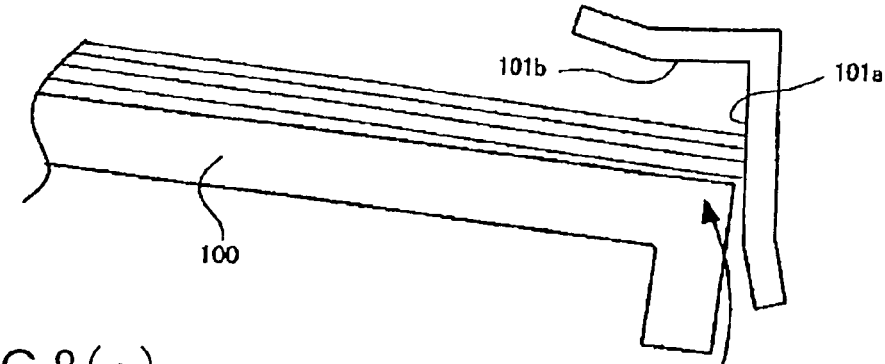
Figure 8C:
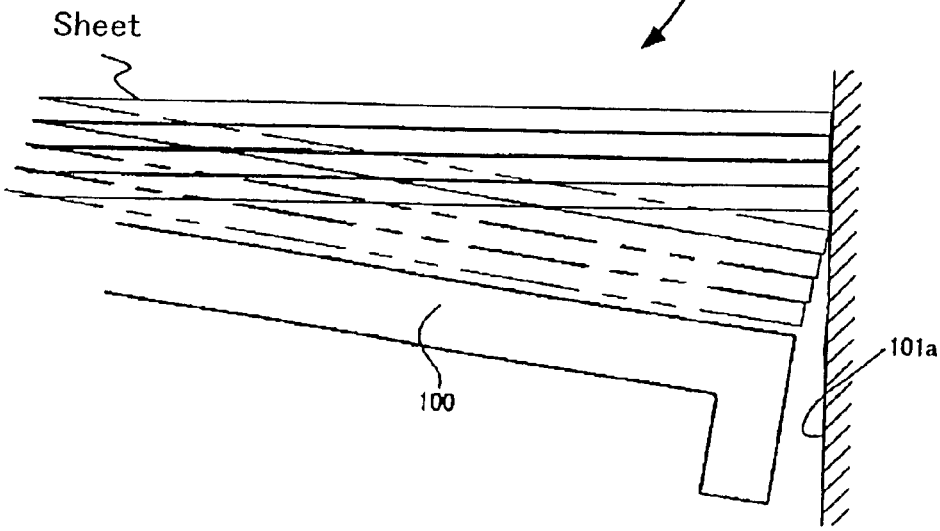

On the stacking tray 1 configured as described above, sheets from the sheet discharging port 22 are stacked on the placement plate 12 on the tray substrate 11. The roller 51 of the aligning means 5 then abuts the sheets against the regulating member 3 for alignment. At this time, the regulating member 3 moves in a vertical direction from a position where it is retracted upward as shown in FIG. 4(*a*) to a state where it is pressed against and engaged with a top surface of the sheets (FIG. 4(*b*)). This vertical operation of the regulating member 3 vibrates the tray substrate 11 in the direction of an arrow in the figure. FIG. 8(*c*) is an enlarged diagram of the condition of the sheets during the vibration in a conventional device. That is, the tray base 100 swings around a support portion of the tray base 100 to displace the leading ends of the sheets forward or backward, resulting in misalignment. In contrast, as shown in FIG. 4(*c*), the placement plate 12 configured as described above, the placement plate 12 is always biased toward the edge engaging surface 31 of the regulating member 3 by the biasing means 18. Accordingly, even when the stacking tray 1 is subjected to vertical vibration resulting from the vertical operation of the regulating member 3, the aligning means 5, or the sheet guide 23, or the like for alignment or to an external impact, the trailing ends of the sheets are prevented from being misaligned in a conveying direction.

Figure 5:
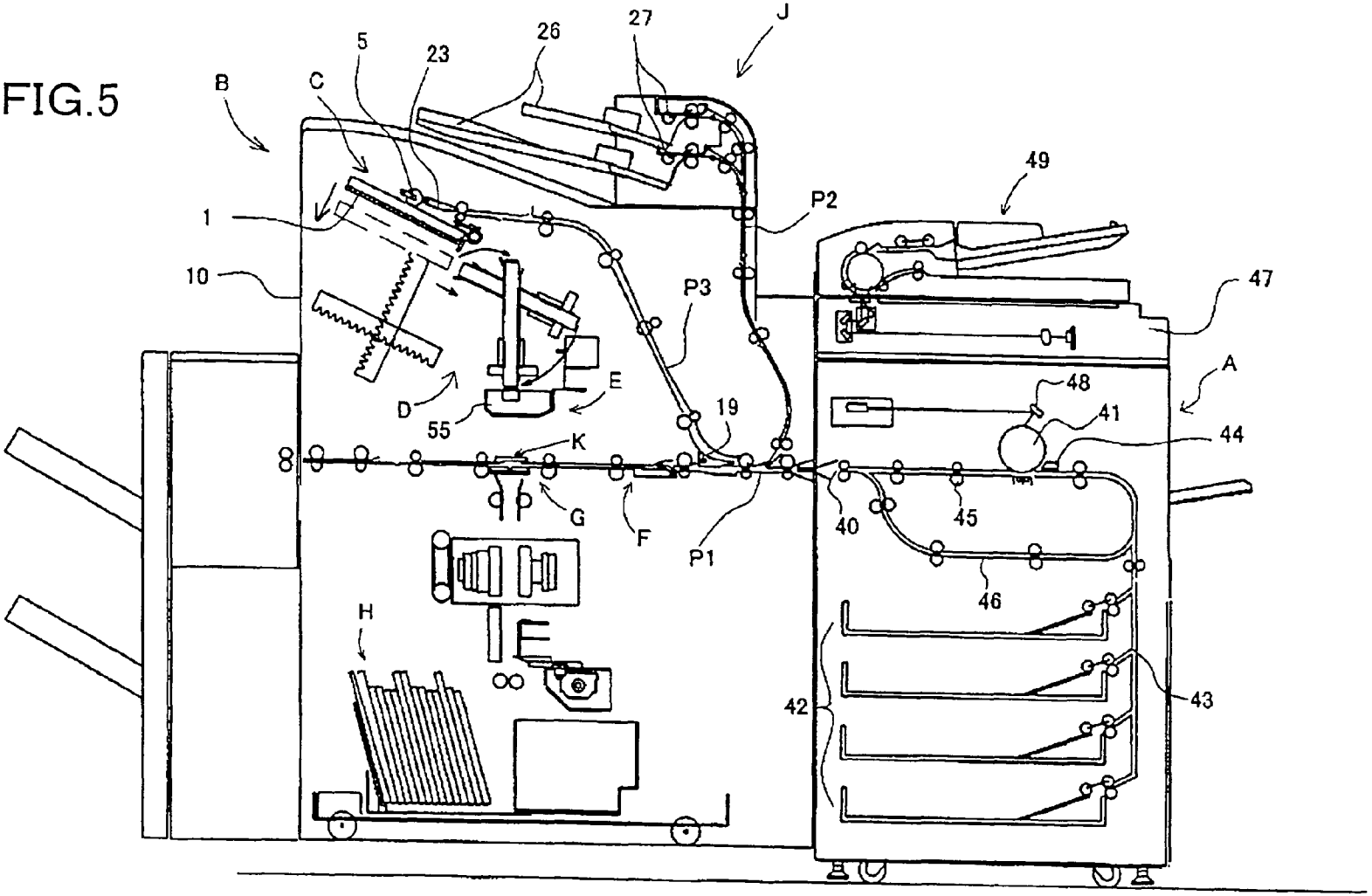
FIG. 5 is a diagram illustrating the entire configuration of a bookbinding apparatus into which the device in FIG. 1 is incorporated.

Now, with reference to FIG. 5, description will be given of a bookbinding apparatus B containing the sheet collecting device C. The bookbinding apparatus B in FIG. 5 is coupled to an image forming apparatus A. The bookbinding apparatus B arranges sheets with images formed thereon by the image forming apparatus A, into a bundle, applies an adhesive such as paste to end surfaces of the sheet bundle, joins the sheet bundle to a cover sheet, and back-folds and presses the cover sheet for bookbinding. FIG. 5 shows such an image forming system. The image forming apparatus A and the bookbinding apparatus B will be described below in this order.

The illustrated image forming apparatus A will be described. The image forming apparatus A is incorporated into a system such as a computer or a word processor to print a series of documents on sheets and carry out the sheets from a sheet discharging port 40. Printing means may be laser, ink jet, or offset printing. The illustrated printing means is composed of a print drum 41 such as an electrostatic drum, a sheet feeding cassette 42 from which sheets are fed to the print drum 41, a print head 48 using laser or the like to form images on the print drum 41, a developing unit 44, and a fixer 45. Sheets of a predetermined size are fed from the sheet feeding cassette 42 to a sheet feeding path 43 on which the print drum 41 is located. The print head 48 forms an electrostatic latent image on the print drum 41. The developing unit 44 attaches toner ink to the latent image. The toner image formed on the print drum 41 is transferred to a sheet. The transferred image is then fixed by the fixer 5. The sheet is finally discharged from the sheet discharging port 40.

Reference numeral 46 in the figure denotes a duplex path along which a sheet with an image printed on one side is turned upside down on a reversal path, guided to the print drum 41 again, and printed on its back side. Reference numeral 47 denotes an image reading device comprising a platen on which a document sheet is set, a scanning carriage that reciprocates along the platen, and a photoelectric conversion element such as a CCD which photoelectrically converts the document image scanned by the carriage. Reference numeral 49 denotes a document supply device comprising a tray on which a document is set in order to automatically supply a document to the platen, a conveying path along which the document from the stray is guided to the platen, and a sheet discharging tray. Document data read by the image reading device is transferred to a data storage in the print head 48. On the other hand, the data storage is connected to an external apparatus such as a computer or a word processor to receive document data from the external apparatus.

Thus, the bookbinding apparatus B in accordance with the present invention comprises "sheet collecting means C" for stacking sheets sequentially carried out from the discharge port 40 in the image forming apparatus A, in order of pages so as to arrange them into a bundle. A "bundle conveying unit D" is provided to transfer the sheet bundle from the sheet collecting means C along the bookbinding path. An "adhesive applying means E" located at an adhesive application position on the bookbinding path, is provided to apply an adhesive to the back of one end of the sheet bundle. A "cover sheet conveying means F" is provided for feeding and setting a cover sheet at a binding position located downstream of the adhesive application position. In addition, a "binding unit G," located at the binding position, is provided to join the cover sheet and the sheet bindle together, and a "housing stack unit H" is provided that houses the bookbound sheet bundle. Each of the arrangements will be described below.

Bundle Conveying Unit

Figure 6:
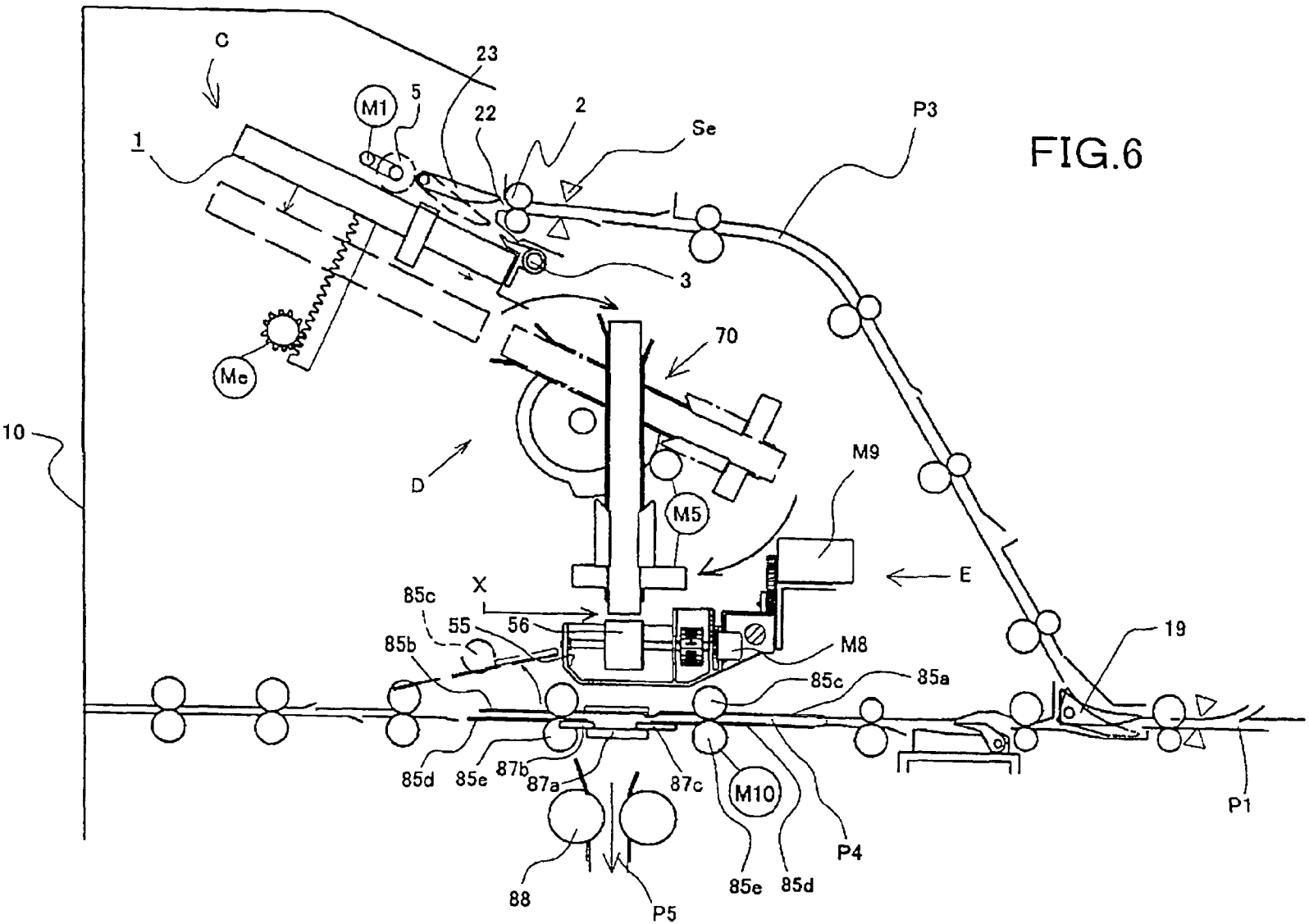
FIG. 6 is an enlarged diagram illustrating an essential part of the apparatus in FIG. 5.
Figure 7:
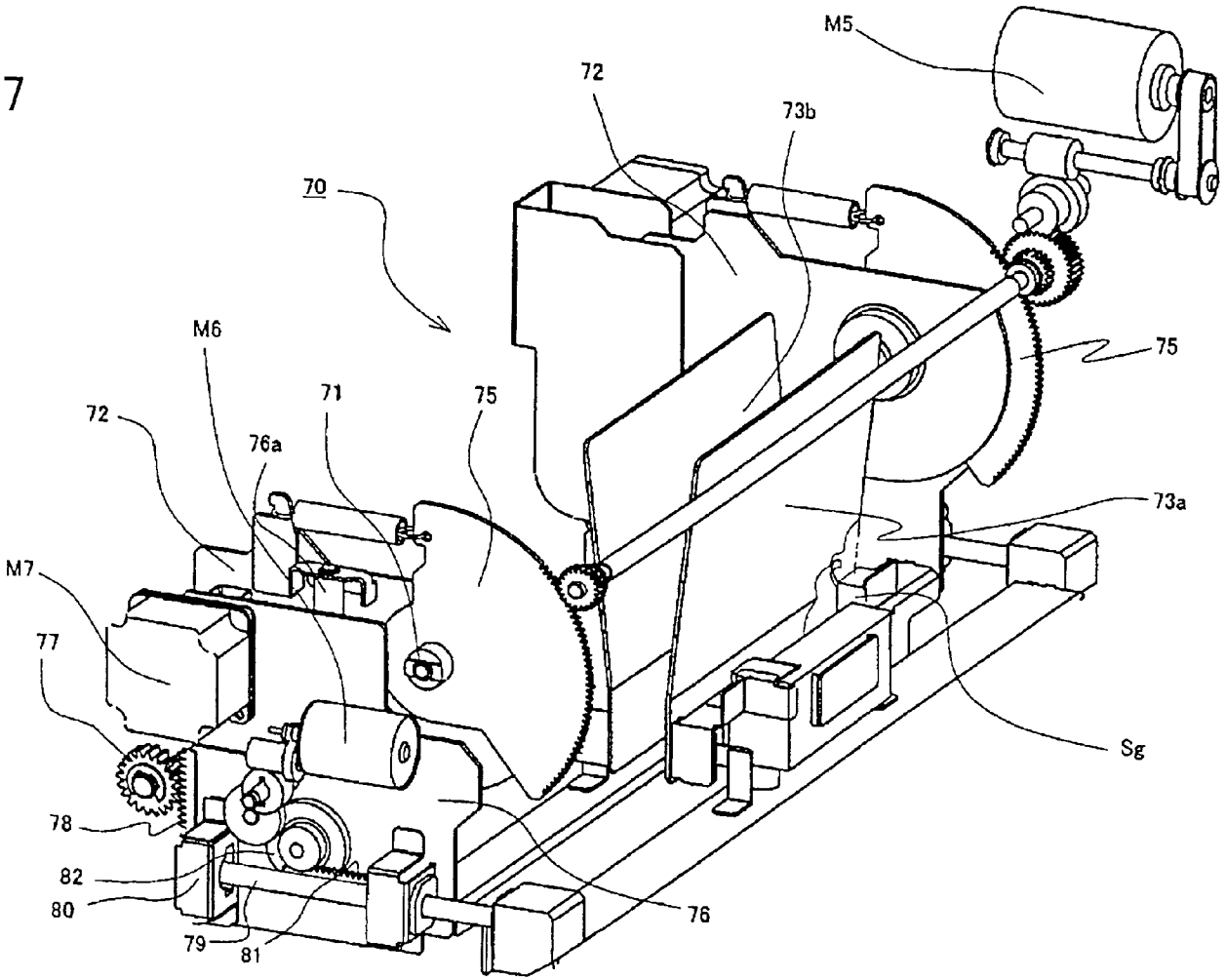
FIG. 7 is a diagram illustrating the configuration of sheet conveying means (grip conveying means) in the apparatus in FIG. 5.

The bundle conveying unit D that conveys a sheet bundle from the collecting tray 1 to the downstream adhesive applying position comprises the grip conveying means 70 as shown in FIG. 7. The grip conveying means 70 is placed on a bookbinding path P5 located so as to cross the bookbinding device B in the vertical direction of the FIG. 6. The grip conveying means 70 receives a sheet bundle in a substantially horizontal posture from the collecting tray 1 and pivots the sheet bundle through 90° into a vertical posture. The grip conveying means 70 then transfers the sheet bundle to the downstream adhesive applying position. Thus, the grip conveying means 70 comprises a pair of clampers 73*a* and 73*b*, which grip a sheet bundle, and a unit frame 72 including the clampers 73*a* and 73*b*. The unit frame 72 is supported by the apparatus frame so as to be rotatable via a shaft 71. The unit frame 72 is pivoted clockwise and counterclockwise by using a pivoting motor M5 provided on the apparatus frame to rotationally drive a fan-shaped gear 75 provided around the shaft 71.

A movable frame 76 is fittingly supported on a guide rail 76*a* (partly shown in FIG. 3) provided on the unit frame 72 thus pivotably supported by the apparatus frame. The movable frame 76 is movable in the vertical direction. A pinion 77 coupled to an elevating and lowering motor M7 provided on the unit frame 72 meshes with a rack gear 78 provided on the movable frame 76. The pair of clampers 73*a* and 73*b* is attached to the movable frame 76 as follows. The fixed clamper 73*b* is fixed to lateral side frames constituting the movable frame 76 at a width size that is appropriate to grip sheets. The movable clamper 73*a* has a rod 79 fittingly supported by a bearing 80 provided on the movable frame 76. A pinion 82 of a grip motor M6 meshes with a rack gear 81 integrated with the rod 79.

Accordingly, the clampers 73*a* and 73*b* are operated by the grip motor M6 to perform a grip operation of gripping a sheet bundle. The clampers 73*a* and 73*b* are then operated by the pivoting motor M5 to turn the gripped sheet bundle from the horizontal posture to the vertical posture. The clampers 73*a* and 73*b* are then operated by the elevating and lowering motor M7 to transfer the sheet bundle in the vertical posture along a sheet conveying path P5 to the downstream adhesive application position X. Reference character Sg denotes a grip end sensor located at the movable clamper 73*a* to detect whether or not the sheet bundle is reliably gripped at a predetermined pressure. The movable clamper 73*a* is moved by the grip motor M6 in a direction in which the sheet bundle is gripped, to approach the fixed clamper 73*b* to engage with the sheet bundle.

Sheet Collecting Means

As shown in FIG. 5, a sheet carry-in path P1 is coupled to the sheet discharging port 40 in the image forming apparatus A. The sheet carry-in path P1 is located in a substantially horizontal direction and comprises a path traversing the center of the apparatus. The sheet carry-in path P1 is connected to a sheet feeding path P2 for an inserter J (described below) that feeds a cover sheet, and a saddle stitching sheet conveying path P3 (sheet discharging path described above) along which sheets from the image forming apparatus A are conveyed. A path switching flapper 19 is provided at a fork in these paths. The saddle stitching sheet conveying path P3 is located so as to guide sheets from the sheet carry-in path P1, located in the center of the apparatus, to the upper part of the apparatus. A sheet discharging roller (sheet conveying means) 2 and a sheet sensor Se are provided at the sheet discharging port 22.

The stacking tray 1 is located downstream of the saddle stitching sheet conveying path P3 so as to form a step below the sheet discharging port 22. The stacking tray 1 has a sheet guide 23, aligning means 5, and the regulating member 3 that regulates the position of the trailing end of a sheet. The sheet guide 23 comprises a guide member that guides a sheet from the sheet discharging port 22 onto the stacking tray 1. The aligning means 5 transfers a sheet placed on the tray after traveling along the sheet guide 23, in a sheet discharging direction (leftward in FIG. 5). With the trailing end of the sheet placed on the tray, the aligning means 5 switches back the sheet so that the sheet travels in the opposite direction (rightward in FIG. 5). The trailing end of the sheet then abuts against the regulating member 3 for alignment. Thus, the aligning means 5 is coupled to a driving motor M2 that can rotate both forward and backward. The sheet guide 23 is swingable so as to move from the sheet discharging port 22 to above the stacking tray 1 to guide and switch back the sheet on the stacking tray 1 to align it with the regulating member 3. Driving means such as a working solenoid (not shown) is coupled to the sheet guide 23. Further, the stacking tray 1 includes the second aligning means 6 for aligning the sheet in the width direction.

Adhesive Applying Means

The adhesive applying means E comprises a paste container 59 accommodating an adhesive such as paste, an application roll 56 rotatably mounted in the container, a driving motor M8 that rotationally drives the application roll 56, and a driving motor M9 that reciprocates the paste container 55 along the sheet bundle. The paste container 55 is formed to have a smaller length (dimension) than the lower edge (back cover after bookbinding) of the sheet cover. The paste container 55 is supported by a guide rail 52 on the apparatus frame so as to move along the lower edge of the sheet bundle together with the application roll 56, contained in the paste container 50. The paste container 55 is coupled to a timing belt attached to the apparatus frame and coupled to the driving motor M9.

Inserter

The sheet bundle with the adhesive applied thereto by the adhesive applying means E is then bound to a cover sheet. Feeding of the cover sheet will be described. Sheets with images formed thereon are sequentially carried out from the sheet discharging port 40 of the image forming apparatus A, where a sheet discharging stacker is normally provided. According to the present invention, the sheet carry-in path P1, serving as the bookbinding device B as described below, is coupled to the sheet discharging port 40. An inserter J is mounted on the sheet carry-in path P1. The inserter J comprises a stack tray 26 having one or more (two illustrated) stages to stack sheets thereon, pickup means 27 for separating a sheet from the other sheets on the stack stray 26, and the sheet feeding path P2, along which the sheet from the pickup means 27 is guided to the sheet carry-in path P1.

The sheets set on the stack tray 26 are supplied to the sheet carry-in path P1 after a series of sheets are carried out from the sheet discharging port 40 of the image forming apparatus A and before another series of sheets are carried out from the sheet discharging port 9 of the image forming apparatus A. That is, when a series of sheets with images formed thereon are carried out of the image forming apparatus A and the final sheet from the image forming apparatus reaches the stack tray 26, one of the sheets on the stack tray 16 starts to be fed. Accordingly, special sheets such as cardboards or coating paper are set on the stack tray 26 as cover sheets and carried into the sheet carry-in path P1 in response to a control signal from the bookbinding device B.

Cover Sheet Conveying Means

In the system in FIG. 5, the sheet feeding path P2 of the inserter J is coupled to the sheet carry-in path P1. A cover sheet from the sheet feeding path P2 is guided to a cover sheet feeding path P4 via the path switching flapper 19. The cover sheet feeding path P4 extends orthogonally to the bookbinding path P5. At the intersection (hereinafter referred to as a binding position K) between cover sheet feeding path P4 and the bookbinding path P5, a cover sheet is joined to a sheet bundle from the bookbinding path P5 for binding so that the cover sheet and sheet bundle form an inverted T shape. The cover sheet feeding path P4 comprises upper conveying guides 85*a* and 85*b* and lower conveying guide 63*d* which are located opposite each other at a predetermined vertical distance between them. The upper conveying guide 85*a* is located on the right side of the intersection (binding position K) between cover sheet feeding path P4 and the bookbinding path P5, whereas the upper conveying guide 85*b* is located on the left side of the intersection. The right and left conveying guides 85*a* and 85*b* are individually opened and closed.

The cover sheet feeding path P4 includes registration means for registering a cover sheet both in a conveying direction and in a direction orthogonal to the conveying direction and cover sheet conveying means F for transferring the cover sheet registered by the registration means to the binding position K. The cover sheet conveying means F comprises a pair of conveying rollers arranged on the cover sheet feeding path P4 and comprise driving rollers 85*e* attached to the lower conveying guide 85*d* and driven rollers 85*c* attached to the upper conveying guides 85*a* and 85*b*. A driving roller M 10 is coupled to the driving rollers 85*e*.

Cover Binding Unit

Cover sheet binding means 87 is provided at the binding position K to join a sheet bundle from the bookbinding path P5 to a cover sheet from the sheet feeding path P4 so that the sheet bundle and cover sheet form an inverted T shape and to press the back (back cover) of the cover sheet. First, on the bookbinding path P5, the adhesive applying means E applies an adhesive to the lower edge of the sheet bundle gripped by the grip conveying means 70. The paste container 55 is retracted to its home position located outside the path. The grip conveying means 70 transfers the sheet bundle along the bookbinding path P5 from the adhesive application position X to the binding position K. At the same time, the cover sheet is fed along a cover sheet feeding path P4 to the binding position, where it is set and remains stationary.

The cover sheet binding means 87 comprises a back rest plate member 87*a* and back folding press member 87*b* and 87*c* as shown in FIG. 6. The back rest plate 87*a* is movable between an operative position where it enters the bookbinding path P5 and a retracting position where it is placed outside the path. The back rest plate 87*a* backs up the cover sheet set and remaining stationary on the cover sheet feeding path P4. The back rest plate 87*a* joins the cover sheet to the sheet bundle transferred from the bookbinding path P5 by the grip conveying means 70 so that the cover sheet and the sheet bundle form an inverted T shape. The back rest plate 87*a* is retracted from the bookbinding path P5 to allow the grip conveying means 70 to carry the sheet bundle to a folding roll 88 positioned downstream of the cover binding means 87.

The disclosure of Japanese Patent Application No. 2006-129669 filed on May 8, 2006 is incorporated as a reference.

While the invention has been explained with reference to the specific embodiments of the invention, the explanation is illustrative and the invention is limited only by the appended claims.

What is claimed is:

1. A sheet collecting device comprising:

a substantially horizontal stacking tray on which sheets are placed;

sheet discharging roller means for transferring sheets to the stacking tray;

abutment regulating means, comprising an abutment regulating member, for regulating a leading end or a trailing end of the sheets on the stacking tray in a conveying direction; and aligning means for aligning the sheets relative to the abutment regulating means, wherein the stacking tray comprises a tray base supported by an apparatus frame, and a plate member disposed on the tray base for placing and supporting at least some of the sheets, the plate member being supported on a top surface of the tray base so as to be movable toward the abutment regulating member, biasing means being provided between the plate member and the tray base to bias the plate member toward the abutment regulating member.

2. The sheet collecting device according to claim 1, wherein the aligning member comprises roller means transferring an uppermost sheet among the sheets placed and housed on the stacking tray to the abutment regulating means to align the sheets relative to the abutment regulating member, and the roller means is coupled to driving means so as to be rotatable forward and backward.

3. The sheet collecting device according to claim 1, wherein the abutment regulating member comprises an edge engaging surface that abuts against the end of the sheets on the stacking tray for alignment and a pressure engaging surface that engages with and depresses a top surface of the uppermost surface, and wherein the abutment regulating member is movable between a retracting position where the abutment regulating member is away from the sheet top surface and a regulating portion where the abutment regulating member engages with the sheet top surface whenever the sheet enters the tray.

4. The sheet collecting device according to claim 1, wherein the tray base comprising the stacking tray is mounted on the apparatus frame so as to be able to elevate and lower in a vertical direction between a sheet housing position and a sheet carry-out position.

5. The sheet collecting device according to claim 4, wherein the stacking tray comprises grip means for gripping a sheet bundle on the stacking tray when the tray moves from the sheet housing position to the sheet carry-out position.

6. A bookbinding apparatus comprising:

a stacking tray on which sequentially fed sheets are stacked and housed;

sheet bundle conveying means for transferring a sheet bundle from the stacking tray to a predetermined processing position;

adhesive applying means for applying an adhesive to the sheet bundle from the stacking tray;

cover binding means for binding a cover sheet to a back of the sheet bundle with the adhesive applied thereto by the adhesive applying means;

abutment regulating member disposed on the stacking tray for regulating one of a leading edge and a trailing edge of sheets on the stacking tray in a conveying direction, and aligning means disposed on the stacking tray for transferring the sheets toward the abutment regulating member;

wherein the stacking tray is supported by an apparatus frame so as to be able to elevate and lower in a vertical direction between a sheet housing position and a sheet carry-out position;

wherein the stacking tray comprises a tray base supported by the apparatus frame so as to be able to elevate and lower in the vertical direction, and a plate member disposed on the tray base for placing and supporting at least some of the sheets; and wherein the plate member is supported on a top surface of the tray base so as to be movable toward the abutment regulating member, biasing means being provided between the plate member and the tray base to bias the plate member toward the abutment regulating member.

7. The bookbinding apparatus according to claim 6, wherein the stacking tray carries out the sheet bundle on the tray toward the sheet bundle conveying means at the sheet carry-out position.

8. The sheet collecting device according to claim 1, wherein the biasing means comprises a spring disposed between the tray base and the plate member for continuously biasing the plate member toward the abutment regulating member.

9. The sheet collecting device according to claim 8, wherein a guide roller is disposed between the plate member and the tray base so as to allow the plate member to move smoothly toward the abutment regulating member.

10. A sheet collecting device comprising:

a substantially horizontal stacking tray on which sheets are placed;

sheet discharging roller means for transferring sheets to the stacking tray;

abutment regulating means, comprising an abutment regulating member, for regulating a leading end or a trailing end of the sheets on the stacking tray in a conveying direction; and aligning means for aligning the sheets relative to the abutment regulating means, wherein the stacking tray comprises a tray base supported by an apparatus frame, and a plate member disposed on the tray base for placing and supporting at least some of the sheets, the plate member being supported on a top surface of the tray base so as to be movable toward the abutment regulating member, biasing means being provided between the plate member and the tray base to bias the plate member toward the abutment regulating member, wherein the abutment regulating means further comprises a motor driven cam which is operatively connected with the abutment regulating member through a shift lever so as to reciprocate the abutment regulating member in a direction vertical with respect to the stacking tray.

11. The sheet collecting device according to claim 10, wherein the abutment regulating member comprises guide rollers which are engaged by the shift lever.

* * * * *